US007941064B2

(12) United States Patent
Morikuni et al.

(10) Patent No.: US 7,941,064 B2
(45) Date of Patent: May 10, 2011

(54) IMAGE FORMING APPARATUS AND IMAGE FORMING METHOD AND DEVELOPING BIAS VOLTAGE ADJUSTMENT THEREIN

(75) Inventors: Shuhichi Morikuni, Nara (JP); Shoji Tomita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 162 days.

(21) Appl. No.: 12/358,311

(22) Filed: Jan. 23, 2009

(65) Prior Publication Data

US 2009/0202260 A1 Aug. 13, 2009

(30) Foreign Application Priority Data

Feb. 7, 2008 (JP) ..... 2008-027683

(51) Int. Cl.
*G03G 15/06* (2006.01)

(52) U.S. Cl. ..... 399/55

(58) Field of Classification Search ..... 399/27, 399/44, 48, 49, 53, 55, 56, 62
See application file for complete search history.

(56) References Cited

U.S. PATENT DOCUMENTS

| | | | | |
|---|---|---|---|---|
| 5,960,232 | A * | 9/1999 | Cheng | 399/55 |
| 7,412,178 | B2 | 8/2008 | Karasawa | 399/49 |
| 2006/0204260 | A1 | 9/2006 | Karasawa | 399/49 |
| 2007/0269228 | A1 * | 11/2007 | Takeuchi et al. | 399/55 X |

FOREIGN PATENT DOCUMENTS

| | | |
|---|---|---|
| JP | 05-002306 | 1/1993 |
| JP | 05-107857 | 4/1993 |
| JP | 2001-042613 | 2/2001 |
| JP | 2002-196552 | 7/2002 |
| JP | 2003-156976 | 5/2003 |
| JP | 2004-078088 | 3/2004 |
| JP | 2004-109599 | 4/2004 |
| JP | 2006-251511 | 9/2006 |

* cited by examiner

*Primary Examiner* — Sandra L Brase
(74) *Attorney, Agent, or Firm* — Renner, Otto, Boisselle & Sklar, LLP

(57) ABSTRACT

Provided is an image forming apparatus including a charging device for charging a photoreceptor drum, a developing device for developing an electrostatic latent image formed on the photoreceptor drum, a developing bias applying device for applying a developing bias voltage to the developing device, a toner image density sensor for detecting an image density of a toner image formed on the photoreceptor drum, and a control portion for controlling an output value of the developing bias applying device, in which the control portion adjusts the developing bias voltage based on an average print coverage of document in previous printing jobs.

9 Claims, 6 Drawing Sheets

*FIG. 4*

| AVERAGE PRINT COVERAGE (%) | TARGET TONER ADHERENT AMOUNT ($mg/cm^2$) |
|---|---|
| LESS THAN 3 % | 600 |
| 3 % OR MORE AND LESS THAN 20 % | 500 |
| 20 % OR MORE AND LESS THAN 50 % | 480 |
| 50 % OR MORE | 450 |

IMAGE FORMING APPARATUS AND IMAGE FORMING METHOD AND DEVELOPING BIAS VOLTAGE ADJUSTMENT THEREIN

This Nonprovisional application claims priority under 35 U.S.C. §119(a) on Patent Application No. 2008-27683 filed in Japan on 7 Feb. 2008, the entire contents of which are hereby incorporated by reference.

BACKGROUND OF THE INVENTION

1. Field of the Invention

The present invention relates to an image forming apparatus and an image forming method, and in particular, to an electrophotographic image forming apparatus for transferring a toner image formed on a surface of a latent image carrier to a recording medium using dual-component developer to output and an image forming method.

2. Description of the Prior Art

In a conventional electrophotographic image forming apparatus, generally, a surface of a latent image carrier (such as a photoreceptor drum) is charged, an electrostatic latent image is formed by exposing the image to the charged region, the electrostatic latent image is visualized (developed) by a developing device as a toner image, the visualized toner image is electrostatically transferred to a recording material such as recording paper, and thereafter the toner image transferred to the recording material is fixed to the recording material by a fixing device.

This type of image forming apparatus has employed a method, in which when dual-component developer including toner, and a magnetic particle and carrier for applying an electric charge to toner is used to perform development, only toner among toner and carrier in developer is adhered to a latent image carrier to be consumed.

Hence, in the image forming apparatus, based on the measurement result of a toner concentration sensor for detecting a toner concentration of developer, the toner concentration control is generally performed so as to keep the toner concentration of the developer constant.

Moreover, it is generally called process control that process conditions such as a charging potential, an exposure amount, and a developing potential are adjusted in response to an environment of an apparatus and the passage of time to obtain a constant-quality image at all times.

As the conventional technology of the process control, a technology is disclosed that in an image forming apparatus, a surface potential of a photoreceptor drum is measured, a toner adherent amount adhering to the photoreceptor drum is predicted based on image data, and the toner adherent amount actually adhering to the photoreceptor drum is measured, to thereby change at least one of image forming conditions including a charging amount, a developing bias voltage, an exposure intensify, and a toner concentration based on the comparison result and adjust the process conditions (for example, refer to Patent Literature 1: Japanese Patent Application Laid-Open Hei 5 No. 2306).

Further, a technology is disclosed that in an image forming apparatus, based on a deviation from a predetermined target value of a measured value for an image density of a reference toner image (hereinafter referred to as "a toner patch"), and conversion coefficients each set correspondingly for a case where the measured value is within a reference density area, a case where the value is within a low density area lower than the reference density area, or a case where the value is within a high density area higher than the reference density area, a toner concentration of developer is controlled (for example, refer to Patent Literature 2: Japanese Patent Application Laid-Open No. 2002-196552).

However, for example, even development condition in which the same developing potential is secured has greatly different development characteristics and printing characteristics depending on the previous print jobs. That is, when low-print jobs are repeated during the process control, decrease in the image density occurs due to roughness in a solid part. This is because stress on developer caused by that turnover of toner is less worsens the fluidity. On the contrary, when high-print jobs continue, developer charging amount is reduced because turnover of toner is much, resulting that the toner adherent amount is increased to cause variation of the image density.

Further, the Patent Literature 1 describes that a toner image density is changed by simply controlling a toner concentration, but does not give consideration to the previous print jobs, thus posing a problem that the image quality is greatly deteriorated in some printing conditions.

Further, in the Patent Literature 2, since a toner concentration is controlled based on the result of only an image density of a toner patch, the surface potential at that time is unclear and merely a developer concentration is secured, thus, similarly to the case of the Patent Literature 1, posing a problem that the image quality is greatly deteriorated in some printing conditions.

Accordingly, it is desired to maintain a predetermined image quality level while considering the environment of an image forming apparatus and the passage of time.

SUMMARY OF THE INVENTION

The present invention has been made in view of the above described conventional problems, and an object is to provide an image forming apparatus capable of, in a developing device using dual-component developer, obtaining a high-quality developed image having a predetermined level or more in response to an environment of the developing device and the passage of time, and an image forming method.

Followings show the image forming apparatus and the image forming method according to the present invention to solve the above described problems.

An image forming apparatus for transferring a toner image formed on a latent image carrier to a recording medium to output an image according to a first aspect of the present invention, includes: a charging portion for charging a surface of the latent image carrier; a developing device for developing an electrostatic latent image formed on the surface of the latent image carrier as a toner image; a developing bias applying portion for applying a developing bias voltage to the developing device; an image density sensor for detecting an image density of the toner image formed on the surface of the latent image carrier; and a control portion for controlling an output value of the developing bias applying portion, and is characterized in that the control portion adjusts the developing bias voltage based on an average print coverage of document in previous print jobs.

Furthermore, an image forming apparatus according to a second aspect of the present invention includes, in addition to the first aspect, a toner concentration sensor for detecting a toner concentration of developer in the developing device.

Furthermore, an image forming apparatus according to a third aspect of the present invention is preferred to be characterized in that, in addition to the first and second aspects, the control portion adjusts the developing bias voltage to be applied to the developing device based on a value calculated by a primary linear approximation obtained from correlation between an effective developing bias voltage and a toner adherent amount on the latent image carrier with respect to the effective developing bias voltage.

Here, the effective developing bias voltage refers to potential difference between the developing bias voltage and the surface potential of the latent image carrier after exposure.

Furthermore, an image forming apparatus according to a fourth aspect of the present invention preferably includes, in addition to the first to third aspects, a table showing a relationship between the average print coverage of document and the toner adherent amount on the latent image carrier, and is characterized in that the control portion corrects adjustment of the developing bias voltage based on the table.

Furthermore, an image forming apparatus according to a fifth aspect of the present invention, preferably includes, in addition to the first to fourth aspects, a surface potential sensor for detecting a surface potential of the latent image carrier, and the control portion determines whether or not a measured value of the surface potential sensor is within a predetermined range, and when the measured value is not within the predetermined range, adjusting the surface potential of the latent image carrier so as to fall within the predetermined range.

Furthermore, an image forming apparatus according to a sixth aspect of the present invention preferably includes, in addition to the fifth aspect, a reporting portion for issuing an alarm, and the control portion operates the reporting portion when the measured value of the surface potential sensor exceeds the predetermined range.

Furthermore, an image forming apparatus according to a seventh aspect of the present invention preferably includes, in addition to the first to sixth aspects, an environmental state detecting portion for detecting a state of a surrounding environment, and the control portion corrects the developing bias voltage depending on change in a measured value of the environmental state detecting portion.

Furthermore, an image forming apparatus according to an eighth aspect of the present invention preferably includes, in addition to the first to seventh aspects, a lifetime counting portion for counting lifetime degree of the developer, and the control portion corrects the developing bias voltage depending on lifetime degree based on a measurement result of the lifetime counting portion.

Furthermore, an image forming method for transferring a toner image formed on a latent image carrier to a recording medium to output an image, according to a ninth aspect of the present invention includes: a step of charging a surface of the latent image carrier; a step of developing an electrostatic latent image formed on the surface of the latent image carrier as a toner image; a step of applying a developing bias voltage to the developing device; a step of detecting a toner concentration of developer in the developing device; a step of detecting an image density of the toner image formed on the surface of the latent image carrier; a step of controlling an output value of the developing bias applying portion; a step of measuring an average print coverage of document in previous print jobs; a step of adjusting the developing bias voltage based on the average print coverage of document; a step of detecting a surface potential of the latent image carrier; a step of, when a value of the surface potential of the latent image carrier is not within a predetermined range, adjusting the surface potential so as to fall within the predetermined range; and a step of forming a plurality of reference toner images on the surface of the latent image carrier.

According to the first aspect of the present invention, by correcting a developing bias voltage based on a previous average print coverage of document to adjust an effective developing bias voltage (|DVB−VL|: herein, DVB shows a developing bias voltage and VL shows a surface potential of the photoreceptor after exposure) by the control portion, it is possible to control the development conditions in view of printing characteristics, thus making it always possible to obtain a high-quality developed image (toner image) having a predetermined level or more in response to an environment of the developing device and the passage of time.

Furthermore, according to the second aspect of the present invention, it is possible to obtain a developed image of further high quality.

Furthermore, according to the third aspect of the present invention, it is possible to control to correct a developing bias voltage easily with respect to a predetermined toner adherent amount.

Furthermore, according to the fourth aspect of the present invention, it is possible to adjust a setting value of a developing bias voltage easily.

Furthermore, according to the fifth aspect of the present invention, it is always possible to obtain a developed image having a certain quality level or more.

Furthermore, by measuring with the surface potential sensor a surface potential of the latent image carrier after having formed an electrostatic latent image thereon, it is also possible to obtain sensitivity information of the latent image carrier and to confirm the deteriorating state of the latent image carrier.

Furthermore, according to the sixth aspect of the present invention, it is possible to inform a user of the abnormality of a member concerning the surface potential of the latent image carrier, such as the latent image carrier or the surface potential sensor.

Furthermore, according to the seventh aspect of the present invention, by providing an environmental state detecting portion for detecting a state of a surrounding environment, counting an environmental state with the environmental state detecting portion, and, for example, adjusting the sensitivity of the toner concentration sensor, it is possible to compensate the influence of the surrounding environment and to detect an image density of a toner image accurately. Accordingly, by correcting the developing bias voltage depending on change in a measured value of the environmental state detecting portion with the control portion, it is possible to control a toner concentration appropriately.

Furthermore, according to the eighth aspect of the present invention, by providing a lifetime counting portion for counting lifetime degree of the developer, measuring the lifetime degree of the developer with the lifetime counting portion, and, for example, by adjusting the sensitivity of the toner concentration sensor, it is possible to detect an image density of a toner image more accurately. Accordingly, with the control portion, by correcting the developing bias voltage depending on lifetime degree based on a measurement result of the lifetime counting portion, it is possible to control a toner concentration appropriately.

Note that, in the present invention, the "lifetime degree" refers to a usage state until reaching a lifetime from an initial state, and an example thereof includes a usage period.

Furthermore, according to the ninth aspect of the present invention, it is possible to control the development conditions in view of printing characteristics, thus making it possible to obtain a high-quality developed image having a predetermined level or more at all times in response to the environment of the developing device and the passage of time.

BRIEF DESCRIPTION OF THE DRAWINGS

FIG. 4 is a table showing a relationship between an average print coverage of document in the image forming apparatus and a toner adherent amount on a photoreceptor drum;

DESCRIPTION OF THE PREFERRED EMBODIMENTS

An embodiment according to the present invention will hereinafter be described with reference to the drawings.

Figure 1:
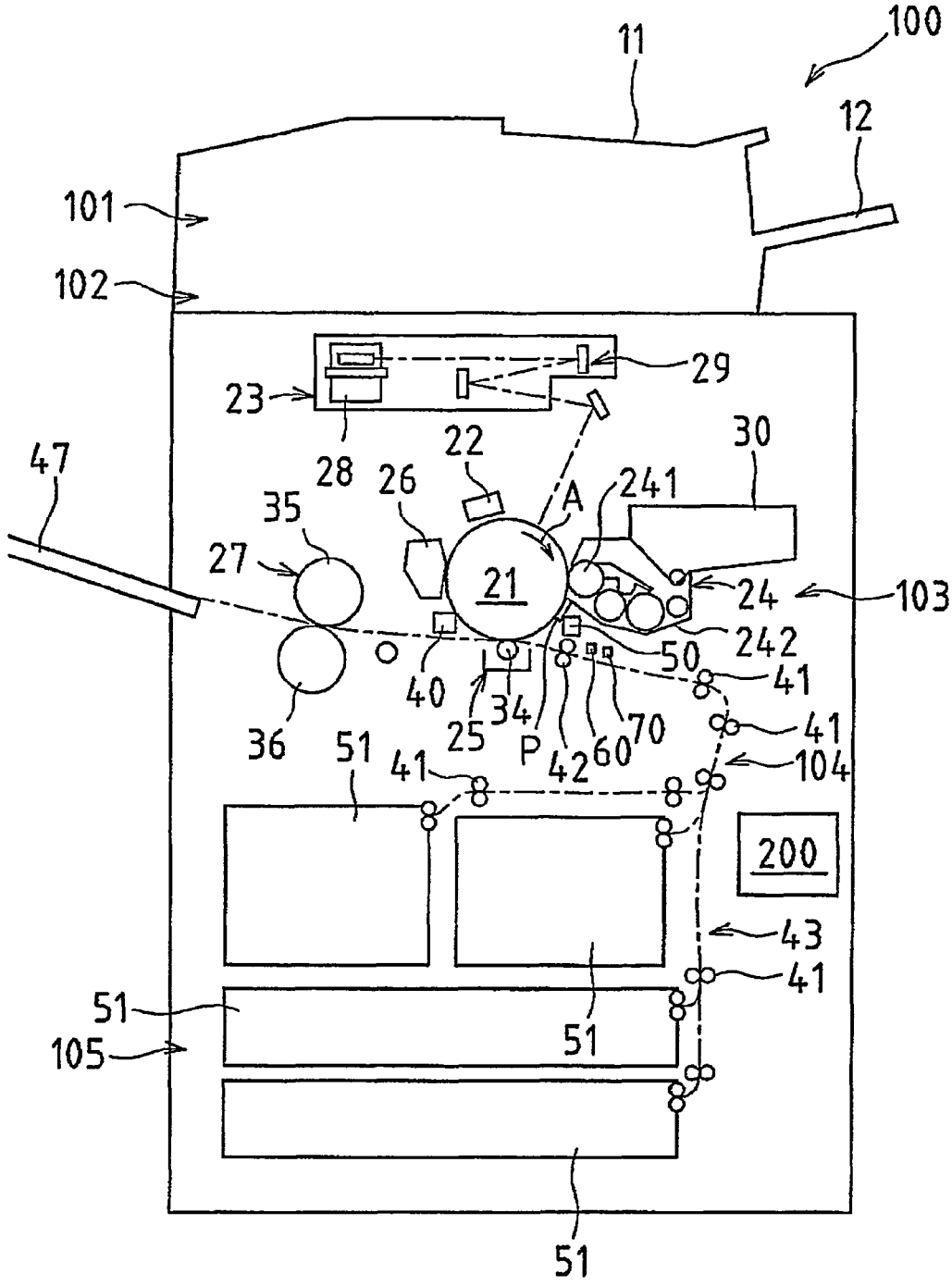
FIG. 1 is a schematic view showing the overall configuration of an image forming apparatus according to an embodiment of the present invention.

FIG. 1 is a schematic view showing the overall configuration of an image forming apparatus according to an embodiment of the present invention.

As shown in FIG. 1, an image forming apparatus 100 according to the present embodiment forms an image by an electrophotographic image forming process, and includes a charging device (charging portion) 22 for charging the surface of a photoreceptor drum (latent image carrier) 21, an optical writing unit (exposure device) 23 for forming an electrostatic latent image on the photoreceptor drum 21, a developing device 24 for developing the electrostatic latent image formed on the surface of the photoreceptor drum 21 as a toner image, a developing bias applying device (developing bias applying portion) 244 (refer to FIG. 2) for applying a developing bias voltage to the developing device 24, and a control portion 200 for controlling an output value of the developing bias applying device 244, so as to transfer the toner image formed on the photoreceptor drum 21 to a transfer sheet (recording medium) to output an image, in which a developing bias voltage by the developing bias applying device 244 is adjusted based on an average print coverage of document of previous printing jobs by the control portion 200 to thereby obtain an excellent toner image.

First, description will be given for the overall configuration of the image forming apparatus 100 according to the present embodiment.

The image forming apparatus 100 reads a document to obtain image data or receives and obtains image data from outside, to form a monochrome image indicated by the image data on a sheet, and the configuration thereof is roughly classified into a document feed portion (ADF: Automatic Document Feeder) 101, an image reading portion 102, an image forming portion 103, a sheet feed portion 104, and a paper supply portion 105, as shown in FIG. 1.

When at least a document is set on a document set tray 11, the document feed portion 101 pulls out documents one by one from the document set tray 11 to feed, guides the documents to the image reading portion 102 to pass through, and discharges the documents to a paper output tray 12.

The image reading portion 102 reads a document image from the document feed portion 101 and transmits image data corresponding to the document image to the control portion 200 including a microcomputer and the like. The image data transmitted from the image reading portion 102 to the control portion 200 undergoes various image processing at the control portion 200 to be output to the image forming portion 103.

The image forming portion 103 includes the photoreceptor drum 21, the charging device 22, the optical writing unit 23, the developing device 24, a transfer unit 25 for transferring a toner image on the photoreceptor drum 21 to a transfer sheet such as recording paper, a fixing unit (fixing device) 27 for fixing a transferred image on a sheet to the sheet, a cleaning unit 26 for removing residual toner remaining on the surface of the photoreceptor drum 21 without being transferred by the transfer unit 25, and a charge erasing device (not shown) for erasing a residual electric charge remaining on the surface of the photoreceptor drum 21.

The photoreceptor drum 21 is formed into a cylindrical shape, and the surface thereof is rotated in a predetermined direction (a direction indicated by the arrow A in the figure in the present embodiment) to be cleaned by the cleaning unit 26, and the cleaned surface is uniformly charged by the charging device 22. In the present embodiment, in order to realize high-speed image forming processing, a circumferential speed of the photoreceptor drum 21 is set at 540 mm/sec, for example.

The charging device 22, for example in the present embodiment, uses a scorotron charger having a grid electrode. Specifically, the charging device 22 in a charger type has a grid electrode between a corona wire and the photoreceptor drum 21, and adjusts a grid voltage under an instruction by the control portion 200 to adjust a surface potential on the photoreceptor drum 21.

The optical writing unit 23 that functions as an exposure device is a laser scanning unit (LSU) including a laser irradiation portion 28 as a laser light source, and a mirror group 29. With image data from the control portion 200 as input, the optical writing unit 23 emits laser light according to the image data from the laser irradiation portion 28, irradiates the laser light through the mirror group 29 to the photoreceptor drum 21, exposes the uniformly charged surface of the photoreceptor drum 21, and forms an electrostatic latent image on the photoreceptor drum 21 surface. Note that, the laser irradiation portion 28 is capable of adjusting a light volume and an irradiation diameter of the laser light to the surface of the photoreceptor drum 21 under an instruction by the control portion 200.

The developing device 24 supplies toner to the surface of the photoreceptor drum 21 to visualize (develop) an electrostatic latent image formed on the photoreceptor drum 21 as a toner image.

The transfer unit 25 transfers the toner image formed on the surface of the photoreceptor drum 21 to a sheet fed by the sheet feed portion 104. Specifically, the transfer unit 25 has an elastic conductive roller 34.

The elastic conductive roller 34 presses the sheet fed from the sheet feed portion 104 against the surface of the photoreceptor drum 21. Moreover, an electric field having an opposite polarity to an electric charge of the toner image on the surface of the photoreceptor drum 21 is applied to the elastic conductive roller 34, and with the electric field in the opposite polarity, the toner image on the surface of the photoreceptor drum 21 is transferred to the sheet. For example, when the toner image has an electric charge of negative (−) polarity, the polarity of the electric field applied to the elastic conductive roller 34 is caused to have the positive (+) polarity.

The cleaning unit 26 removes and collects toner remaining on the surface of the photoreceptor drum 21 after development and transfer.

The fixing unit 27 heats and presses the sheet having the toner image transferred thereto at the transfer unit 25 to fix the toner image on the sheet.

Specifically, the fixing unit 27 includes a pair of fixing rollers (a heat roller 35 and a pressing roller 36 in the present embodiment). Provided inside the heat roller 35 is a heat source (not shown) for setting a temperature on the surface of the heat roller 35 to a predetermined temperature (fixing temperature: about 160 to 200° C.). In addition, pressing members (not shown) are disposed at both ends of the pressing roller 36 so that the pressing roller 36 is brought into press contact with the heat roller 35 at a predetermined pressure.

In the fixing unit 27 having such configuration, when a sheet is fed to a press contact portion (referred to as a fixing nip portion) between the heat roller 35 and the pressing roller 36, an unfixed toner image on the sheet is heated/fused and pressed to be fixed onto the sheet while the sheet is fed by the heat roller 35 and the pressing roller 36.

The sheet feed portion 104 includes plurality pairs of feed rollers 41 for feeding sheets from the paper supply portion 105, a pair of registration rollers 42, and a feed path 43.

The paper supply portion 105 includes a plurality of paper supply trays 51. Each of the paper supply trays 51 stores sheets and is provided in the lower part of the image forming apparatus 100. Moreover, each of the paper supply trays 51 includes a pick-up roller (not shown) for pulling out sheets one by one, and conveys the sheet pulled out by the pick-up roller to the feed path 43 of the sheet feed portion 104. When the image forming apparatus 100 aims to perform high-speed image forming processing, for example, each of the paper supply trays 51 secures capacity capable of storing 500 to 1500 pieces of sheets of a fixed size.

The feed path 43 feeds by the registration roller 42 the sheet received from the paper supply portion 105 to the transfer unit 25 in synchronization with a toner image on the rotating photoreceptor drum 21, and further feeds the sheet to the fixing unit 27. Moreover, the sheet fixed by the fixing unit 27 is further fed by the sheet feed portion 104 to the paper output tray 47 to be discharged.

Next, detailed description will be given for the characteristic configuration of the image forming apparatus 100 of the present embodiment.

As shown in FIG. 1, the image forming apparatus 100 is provided with a surface potential sensor 40 and a toner image density sensor 50, in addition to the above mentioned configuration.

The surface potential sensor 40 detects a surface potential on the photoreceptor drum 21. The surface potential sensor 40 may be disposed at any position around the photoreceptor drum 21. In the present embodiment, the surface potential sensor 40 is disposed, as shown in FIG. 1, in the downstream side from the transfer unit 25 and in the upstream side from the cleaning unit 26 in a rotating direction (direction indicated by the arrow A) of the photoreceptor drum 21.

The toner image density sensor 50 detects an image density of a toner image formed on the photoreceptor drum 21. The toner image density sensor 50 may be disposed at any position around the photoreceptor drum 21. In the present embodiment, the toner image density sensor 50 is disposed, as shown in FIG. 1, in the downstream side from the developing device 24 and in the upstream side from the transfer unit 25 in a rotating direction (direction indicated by the arrow A) of the photoreceptor drum 21.

Note that, for both of the surface potential sensor 40 and the toner image density sensor 50, similar ones used in a conventional image forming apparatus can be used. Accordingly, description for the further detailed configuration of these members will be omitted.

The image forming apparatus 100 is further provided with, for example, a temperature sensor 60 for detecting a temperature and a humidity sensor 70 for detecting a humidity as an environmental state detecting portion for detecting the condition of the surrounding environment.

The temperature sensor 60 and the humidity sensor 70 may be disposed at any position in the image forming apparatus 100. In the present embodiment, as shown in FIG. 1, the temperature sensor 60 and the humidity sensor 70 are disposed in a vicinity of the toner image density sensor 50.

Next, detailed description will be given for characteristic electric control of the image forming apparatus 100 based on the block diagram.

Figure 2:
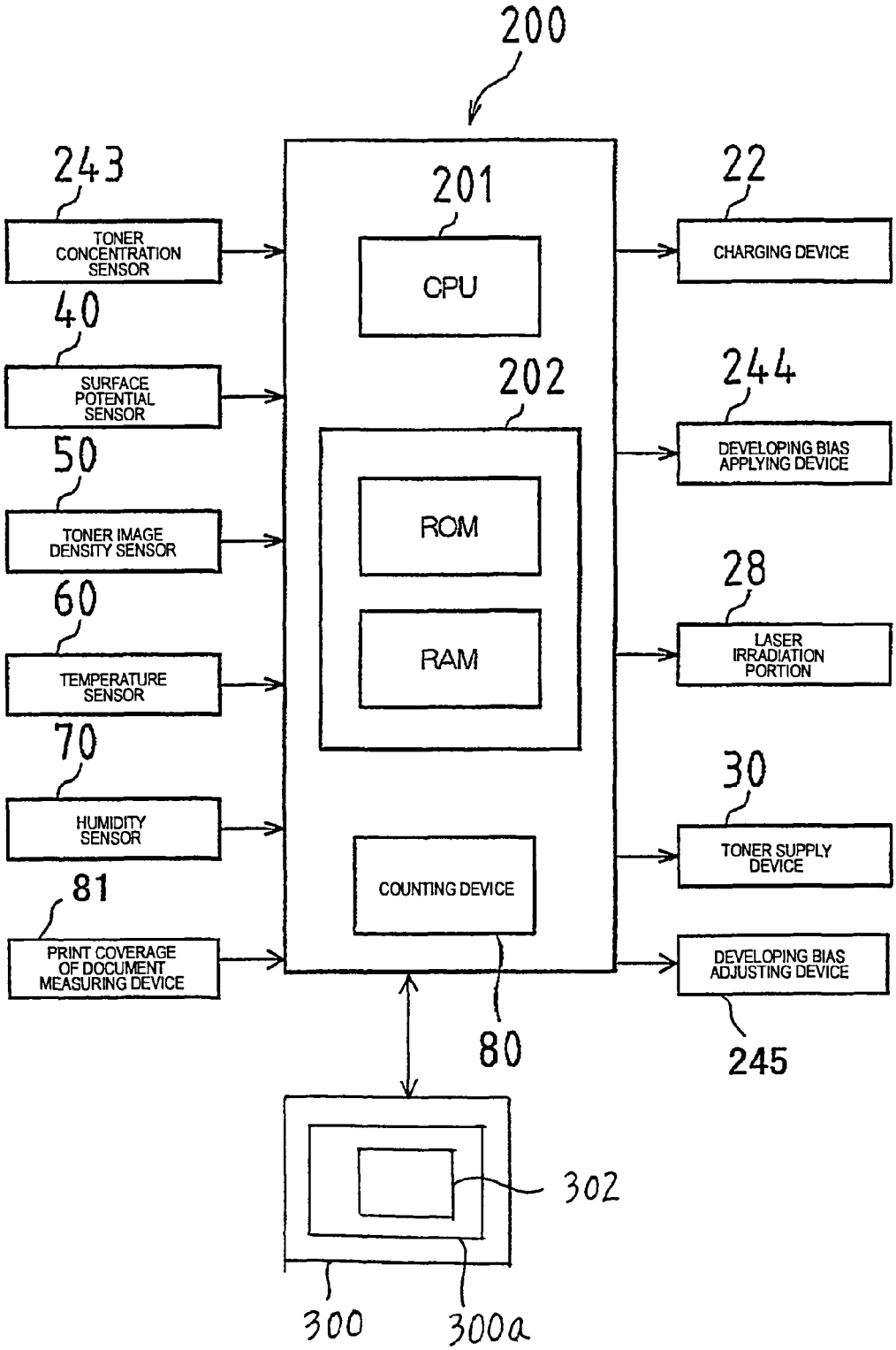
FIG. 2 is a schematic block diagram of a control system mainly showing a control portion of the image forming apparatus.

FIG. 2 is a schematic block diagram of a control system mainly showing the control portion of the image forming apparatus according to the present embodiment.

As shown in FIG. 2, the control portion 200 includes a central processing unit (CPU) 201, a storage portion 202, and a counting device (lifetime measuring portion) 80 for counting the number of times of image forming, a driving time of the image forming apparatus 100, and the like.

By the CPU 201, the control portion 200 reads various kinds of control programs from the storage portion 202 and executes the read control programs to perform image forming process control.

The storage portion 202 stores various kinds of control programs and necessary functions, and includes a read-only memory, ROM (Read Only Memory) and a memory for performing reading/writing of data, RAM (Random Access Memory).

The control portion 200 has an input system connected to the surface potential sensor 40, the toner image density sensor 50, the temperature sensor 60, the humidity sensor 70, a print coverage of document measuring portion 81, and a toner concentration sensor 243, and an output system connected to the charging device 22, the laser irradiation portion 28, a toner supply device 30, the developing bias applying device 244, and a developing bias adjusting device 245.

Specifically, the surface potential sensor 40, the toner image density sensor 50, the temperature sensor 60, the humidity sensor 70, the print coverage of document measuring portion 81, and the toner concentration sensor 243 are electrically connected to the input system of the control portion 200 so that each of sensor output values is transmitted to the control portion 200.

The charging device 22 is electrically connected to the output system of the control portion 200 so that an operation signal for adjusting a grid voltage is received from the control portion 200.

The laser irradiation portion 28 is electrically connected to the output system of the control portion 200 so that an operation signal for adjusting a light volume of laser light and an operation signal for adjusting an irradiation diameter are received from the control portion 200.

The toner supply device 30 is electrically connected to the output system of the control portion 200 so that an operation signal is received from the control portion 200.

The developing bias applying device 244 is electrically connected to the output system of the control portion 200 so that an operation signal for adjusting a developing bias voltage in which an AC voltage is superimposed to a DC voltage is received from the control portion 200.

The developing bias adjusting device 245 is electrically connected to the output system of the control portion 200 so that an operation signal for performing correction control of a developing bias voltage periodically based on the measurement result of the previous average print coverage of document to control the developing bias voltage based on the measurement result of the print coverage of document measuring portion 81 is received from the control portion 200.

Note that, in a conventional image forming apparatus, a set developing bias voltage is not changed during each process control.

A print coverage of document refers to a rate of a print coverage of a document. An average print coverage of a document is an average of print coverage of a document of a plurality of documents.

Next, the detailed description will be given for processing contents of the characteristic control portion 200 of the image forming apparatus 100, with reference to the drawings.

Figure 3:
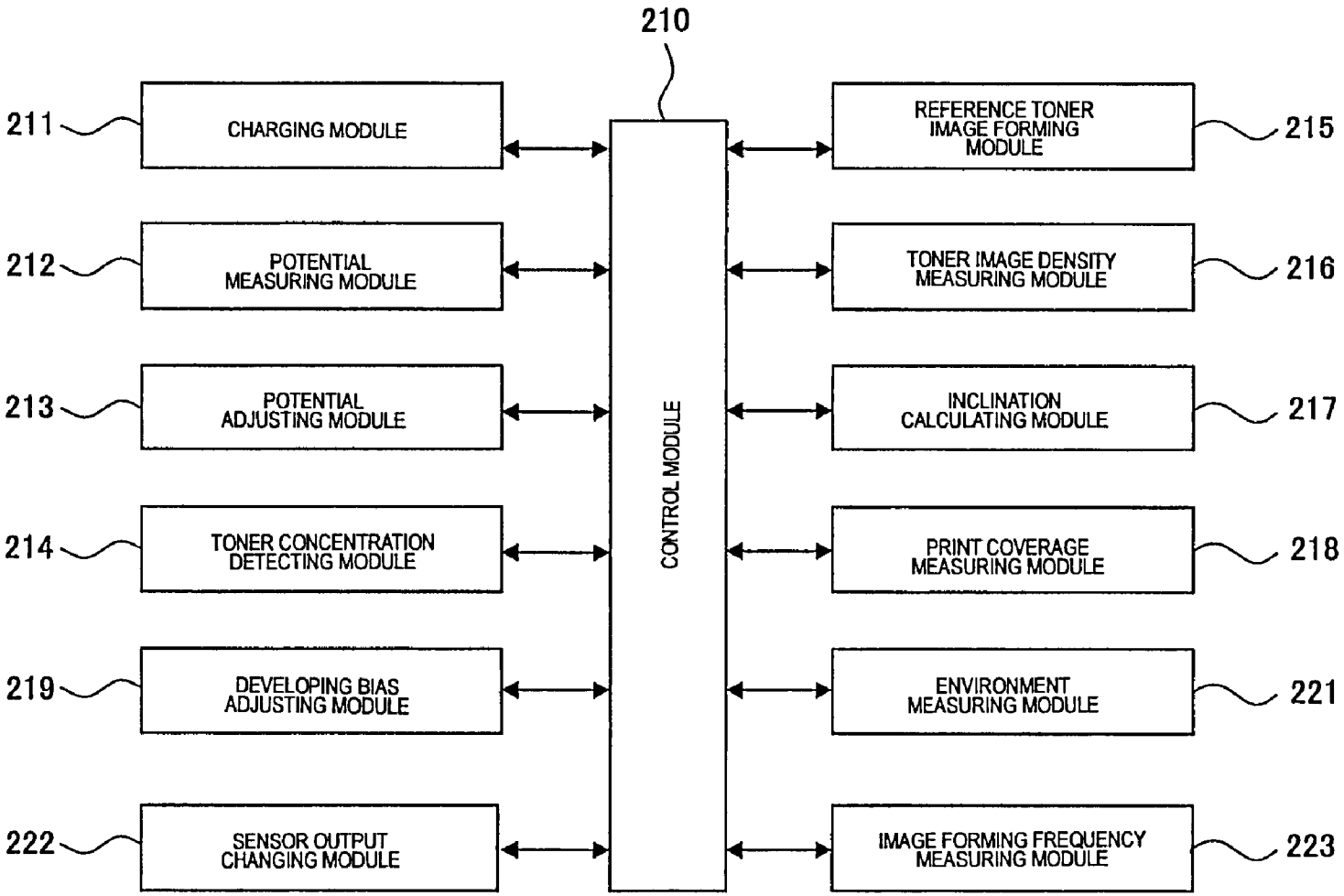
FIG. 3 is an illustrative view showing a processing function of the control portion of the image forming apparatus.

FIG. 3 is an illustrative view showing a processing function of the control portion of the image forming apparatus according to the present embodiment, and FIG. 4 is a table showing a relationship between an average print coverage of document in the image forming apparatus and a toner adherent amount on the photoreceptor drum.

As shown in FIG. 3, a processing program of the control portion 200 includes a charging module 211, a surface potential measuring module 212, a surface potential adjusting module 213, a toner concentration detecting module 214, a reference toner image forming module 215, a toner image density measuring module 216, an inclination calculating module 217, a print coverage of a document measuring module 218, a developing bias adjusting module 219, an environment measuring module 221, a sensor output changing module 222, an image formation frequency measuring module 223, a control module 210 for controlling these modules, and the like. Moreover, in order to operate the configurations, the control portion 200 functions modules corresponding to the configurations.

In addition, as shown in FIG. 4, the control portion 200 includes a table showing a relationship between an average print coverage of document in print jobs and a toner adherent amount on the photoreceptor drum 21.

In the table, the average print coverage of document is classified into ranges of less than 3%, 3% or more and less than 20%, 20% or more and less than 50%, and 50% or more, and target values for the toner adherent amount corresponding to average print coverage of document in each range are previously set.

The charging module 211 has a function of charging the surface of the photoreceptor drum 21 that has been cleaned and whose electric charge has been erased, when performing toner concentration control. Specifically, the charging module 211 is a program for uniformly charging the surface of the photoreceptor drum 21 by the charging device 22.

The surface potential measuring module 212 has a function of measuring a surface potential V0 before laser irradiation on the photoreceptor drum 21 by the surface potential sensor 40. Specifically, the surface potential measuring module 212 is a program for causing the surface potential sensor 40 to measure the surface potential V0 uniformly charged on the photoreceptor drum 21 to transmit the measurement result to the control module 210 of the control portion 200.

The surface potential adjusting module 213 has a function of performing potential determination as to whether or not the surface potential V0 based on the measurement result by the surface potential sensor 40 is within a predetermined range, and when it is determined as exceeding the predetermined range as a result of the potential determination, adjusting the surface potential so as to fall within the predetermined range.

Specifically, the surface potential adjusting module 213 is a program for firstly performing determination as to whether or not the surface potential V0 is within a predetermined range with the laser irradiation portion 28 turned OFF, and when exceeding the predetermined range, adjusting a grid voltage of the charging device 22 so as to fall within the predetermined range.

The toner concentration detecting module 214 has a function of detecting a toner concentration of developer, but is not essential in the present invention and used as one of control items.

The reference toner image forming module 215 has a function of forming a plurality of toner patches, whose developing bias voltage is changed, every predetermined time (for example, for ever two seconds) on the photoreceptor drum 21, when it is determined as within the predetermined range as a result of the potential determination.

Specifically, the reference toner image forming module 215 includes a latent image forming module for irradiating light having predetermined intensity from the laser irradiation portion 28 onto the photoreceptor drum 21 to form an electrostatic latent image for a toner patch, and a latent image developing module for developing the electrostatic latent image for a toner patch with a different developing bias voltage to form a plurality of toner patches. Note that, the toner patch here is defined as, for example, a full high-density image (so-called a solid image).

The toner image density measuring module 216 has a function of measuring with the toner image density sensor 50 image densities of the plurality of toner patches formed on the photoreceptor drum 21.

Specifically, the toner image density measuring module 216 is a program for measuring with the toner image density sensor 50 image densities of the plurality of toner patches formed on the photoreceptor drum 21 by the latent image developing module to transmit the measurement result to the control module 210 of the control portion 200.

The inclination calculating module 217 is a program for plotting the measurement result (toner adherent amount) by the toner image density sensor 50 for a developing bias potential to calculate the inclination by a graph thereof. In calculation, for example, a primary linear approximation is used.

The print coverage of document measuring module 218 is a program for measuring a document printing rate during previous process control. For example, when an average print coverage is at 2%, the toner consumption is smaller than the case of a document printing rate in a normal setting. Accordingly, such a printing rate causes decrease in the image density due to roughness in a solid part.

The developing bias adjusting module 219 is a program for controlling to correct a developing bias voltage based on the result of the print coverage of document measuring module 218. Note that, since a conversion table or a conversion formula of a print coverage of document and a developing bias voltage is previously stored in the storage portion 202, the CPU 201 controls so as to reach the corresponding developing bias voltage with reference to the conversion table or the conversion formula.

As a result, by holding and maintaining a relation table of the graph in which the measurement result (toner adherent amount on the photoreceptor) of the toner image density sensor 50 for a developing bias voltage is plotted, it is possible to change a setting value of the developing bias voltage easily.

In addition, after the developing bias control for developer is completed, the control portion 200 turns to the state capable of performing image forming.

Moreover, when the document printing rate measuring module 218 determines as within the predetermined range, control of a developing bias voltage is not particularly performed.

As a result, according to the image forming apparatus 100 illustrated in the present embodiment, it is possible to secure a predetermined developing potential and to always obtain a developed image having a certain level or more.

Note that, in the image forming apparatus 100 illustrated in the present embodiment, a circumferential speed of the photoreceptor drum 21 is high, 540 mm/sec, and the present invention is effective for such an image forming apparatus whose image forming process speed is fast. This is because the developing device 24 is also rotated at a high speed and the stress on developer is therefore increased.

Next, detailed description will be given for processing for controlling a developing bias voltage for developer by the control portion 200 based on the flowchart.

Figure 5:
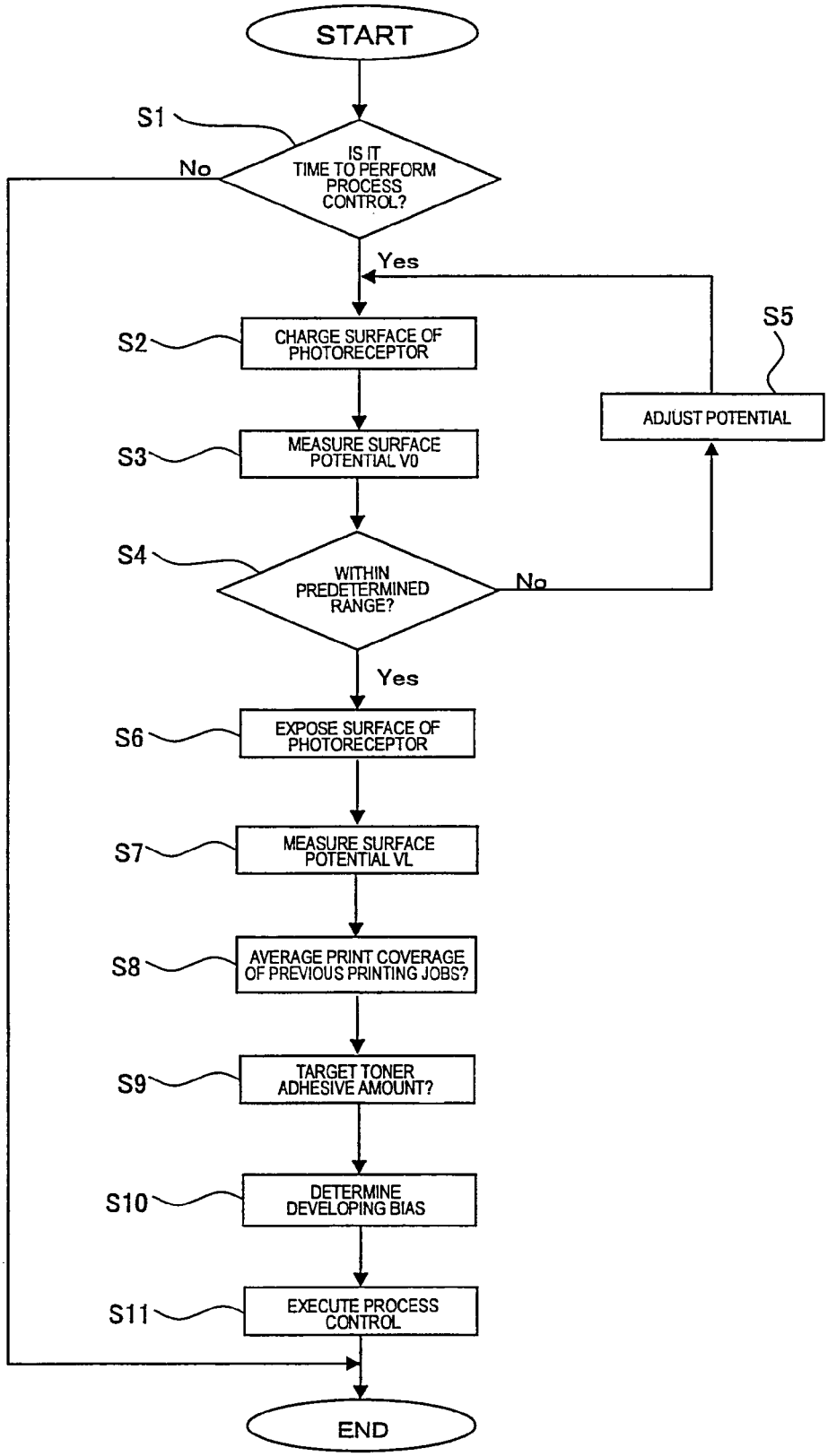
FIG. 5 is a flowchart showing an example of a flow of processing for performing developing bias control of developer in the image forming apparatus.
Figure 6:
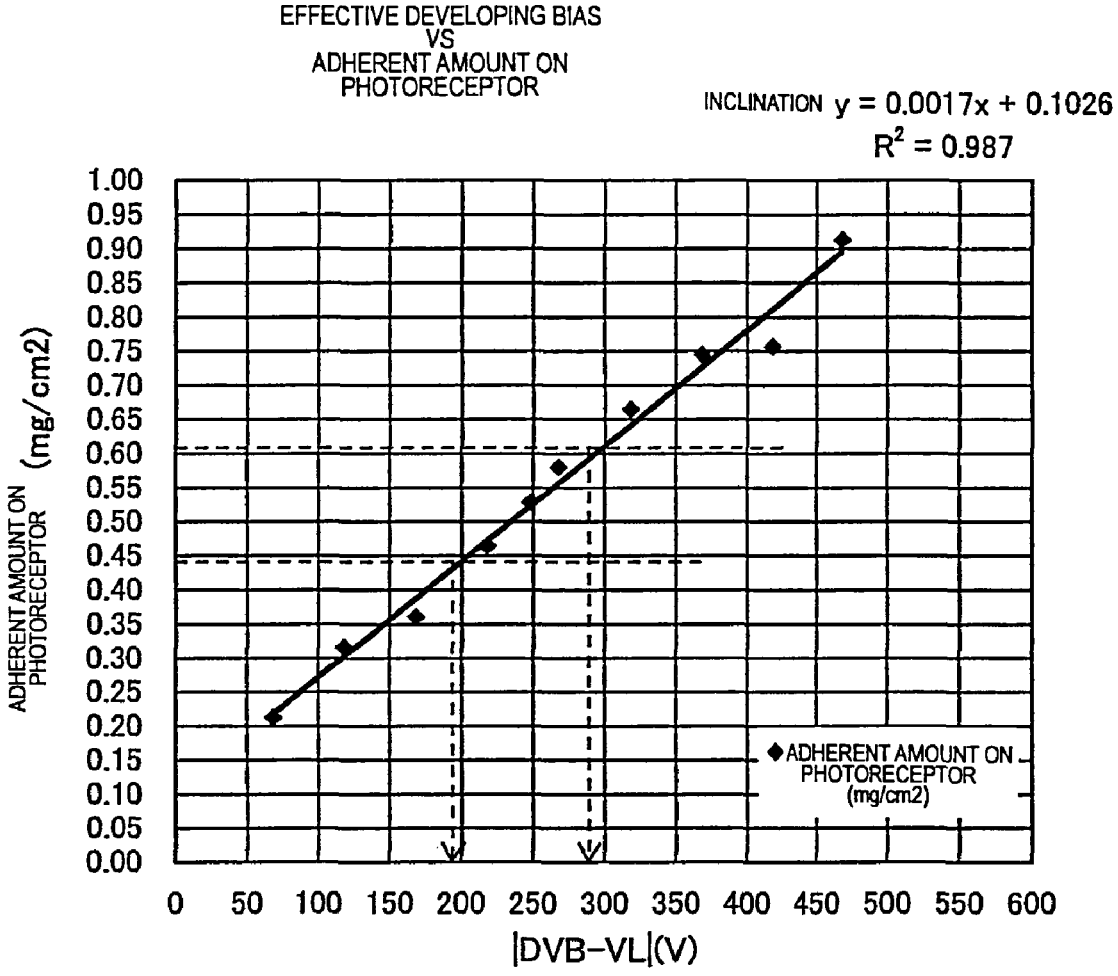
FIG. 6 is a graph showing a relationship between an effective developing bias voltage in the image forming apparatus and a toner adherent amount on the photoreceptor drum.

FIG. 5 is a flowchart showing an example of a flow of processing for performing developing bias control of developer in the image forming apparatus of the present embodiment, and FIG. 6 is a graph showing a relationship between an effective developing bias voltage in the image forming apparatus and a toner adherent amount on the photoreceptor drum.

When controlling a developing bias voltage in the image forming apparatus 100, as shown in FIG. 5, first, whether or not a period when process control is needed is determined by the control module 210 (step S1).

At step S1, when it is determined it is not a time to perform process control, nothing is performed. Alternatively, when it is determined it is a time to perform process control, the charging module 211 causes the charging device 22 to charge the surface of the photoreceptor drum 21 (step S2).

Then, a surface potential V0 of the photoreceptor drum 21 at that time is measured by the surface potential measuring module 212 in the surface potential sensor 40 (step S3), and whether or not the measurement value is within a predetermined range is determined by the surface potential adjusting module 213 (step S4).

At step S4, when it is determined that the measurement value is not within the predetermined range, adjustment of the surface potential is repeated by the surface potential adjusting module 213 (step S5). Alternatively, when the measurement value is within the predetermined range, the surface of the photoreceptor drum 21 is exposed by the laser irradiation portion 28 (step S6). A surface potential VL of the photoreceptor drum 21 at that time is measured by the surface potential measuring module 212 in the surface potential sensor 40 (step S7).

An average print coverage of document of jobs during the previous process control is measured by the print coverage of document measuring portion 81 (step S8). Then, a target toner adherent amount (toner adherent amount adhering to the surface of the photoreceptor drum 21) corresponding to the average print coverage of document is confirmed with reference to a table stored in the storage portion 202, in which a target toner adherent amount corresponding to each printing rate is prescribed (step S9).

As a result, for example, based on a conversion table of a print coverage of document and a developing bias voltage or a conversion formula, shown in FIG. 6, obtained by the relationship between an effective developing bias voltage and a toner adherent amount on the photoreceptor drum, an effective developing bias voltage (|DVB−VL|) corresponding to a predetermined print coverage of document (3% or more and less than 20% in default) is obtained to determine a developing bias voltage corresponding to the value (step S10). Accordingly, a developing bias voltage may not be changed depending on a situation. Thereafter, subsequent process control is performed with the changed developing bias voltage (step S11).

That is, the control module 210 reads a value of the developing bias voltage stored in the storage portion 202 to output to the developing bias adjusting module 219 with a control signal for changing the developing bias voltage, and the developing bias adjusting module 219 operates the developing bias adjusting device 245.

With the above mentioned configuration, according to the present embodiment, the characteristic control portion 200 constituting the image forming apparatus 100 enables to adjust a developing bias voltage based on the average print coverage of document in previous print jobs, resulting that it is possible to control the development conditions in view of printing characteristics, and always to obtain a high-quality developed image (toner image) having a predetermined level or more at all times in response to the environment of the developing device and the passage of time.

Further, in the present embodiment, the image forming apparatus 100 includes, as shown in FIG. 2, the temperature sensor 60 for detecting a temperature and the humidity sensor 70 for detecting a humidity as an environmental condition detecting portion for detecting the condition of the surrounding environment, and includes, as shown in FIG. 3, the environment measuring module 221 and the sensor output changing module 222 as modules in the control portion 200.

The environment measuring module 221 is a program for measuring a surrounding temperature and/or humidity by the temperature sensor 60 and/or the humidity sensor 70. The sensor output changing module 222 changes a center value of sensor output values of the toner concentration sensor 243 depending on the change in temperature and/or humidity (herein, temperature and humidity) based on the measurement result of the environment measuring module 221.

Specifically, in the image forming apparatus 100, as the surrounding environment changes, a bulk density of developer also changes, and therefore, for example, when a center value of sensor output values of the toner concentration sensor 243 is 2.10 V (toner adherent amount 0.525 mg/cm$^2$) at a normal temperature and normal humidity (indicated as N/N), an output value of the sensor may be increased at a high temperature and high humidity (indicated as H/H), for example, by setting a center value of sensor output values to 2.20 V (toner adherent amount 0.550 mg/cm$^2$). On the other hand, an output value of the sensor may be reduced at a low temperature and low humidity (indicated as L/L), for example, by setting a center value of sensor output values to 2.00 V (toner adherent amount 0.500 mg/cm$^2$). Note that, the present embodiment illustrates values when the diffuse reflection type optical diode of GP2TC1J000F (manufactured by SHARP K.K.) is used as the toner concentration sensor 243.

Further, it can be illustrated such that the low temperature is at around 5° C. to 10° C., the normal temperature is at around 20° C. to 25° C., and the high temperature is at around 30° C. to 35° C. Moreover, it can be illustrated such that the low humidity is at around 20% to 40%, the normal humidity is at around 50% to 65%, and the high temperature is at around 70% to 90%.

With the above mentioned configuration, according to the present embodiment, by changing a developing bias voltage depending on change in the environmental condition of developer, it is possible to compensate the influence of the surrounding environment to maintain a further fine image level.

Further, in the present embodiment, the image forming apparatus 100 includes in the control portion 200 the counting device 80 as a lifetime measuring portion for counting lifetime degree of developer, as shown in FIG. 2, in place of or in addition to the above mentioned environmental condition detecting portion. The counting device 80 counts the number of times of image forming, a driving time of the image forming apparatus, and the like. Note that, the "lifetime degree" refers to a usage state until reaching a lifetime from an initial state, and an example thereof includes a usage period.

Further, as shown in FIG. 3, the image forming apparatus 100 includes as modules of the control portion 200 the image forming frequency measuring module 223 and the sensor output changing module 222. The image forming frequency measuring module 223 is a program for measuring lifetime degree of developer with the counting device 80. The sensor output changing module 222 is a program for changing a center value of sensor output values of the toner concentration sensor 243 depending on the lifetime degree (herein, counted value) based on the measurement result of the image forming frequency measuring module 223.

Specifically, in the image forming apparatus 100, as the lifetime degree of developer changes, a bulk density and fluidity of developer also change, and therefore, for example, when a center value of sensor output values of the toner concentration sensor 243 is 2.20 V (toner adherent amount 0.550 mg/cm$^2$) in the initial state, a center value of sensor output values may be 2.10 V (toner adherent amount 0.525 mg/cm$^2$) at 50 thousand counts and be 2.0 V (toner adherent amount 0.500 mg/cm$^2$) at 100 thousand counts.

With the above mentioned configuration, according to the present embodiment, by changing a developing bias voltage depending on the lifetime degree of developer, it is possible to maintain a further fine image level.

Meanwhile, since the toner charging performance of developer becomes unstable right after toner supply, in the present embodiment, it is better not to perform toner concentration control of developer right after toner supply.

Further, in the present embodiment, although it is premised that a measured value of a surface potential of the photoreceptor drum 21 falls within a predetermined range that has been previously set, when this can not be secured, it is also predicted that trouble occurs in the photoreceptor drum 21 or the surface potential sensor 40.

Hence, as a modified example of the present embodiment, for example, when a measured potential based on the measurement result by the surface potential sensor 40 exceeds the predetermined range, alarm may be issued.

Illustrated as an aspect for issuing an alarm is such that an alarm device (reporting portion) 302 for issuing alarm display on a display portion 300*a* of an operation portion 300 in the image forming apparatus 100 is provided (FIG. 2), the control portion 200 determines whether or not a measured potential based on the measurement result by the surface potential sensor 40 exceeds the predetermined range, and as a result of the determination, when it is determined that the measured value exceeds the predetermined range and determined as after potential adjustment, an alarm signal is issued for the alarm display.

With the above mentioned configuration, according to the present embodiment, by constituting the image forming apparatus 100 so that an alarm is issued when a measured value of a surface potential exceeds the predetermined range, it is possible to inform a user of the abnormality of a member concerning the surface potential (such as a latent image carrier or a surface potential sensor).

Having described preferred embodiments of the present invention, it goes without saying that the present invention should not be limited to the above described examples, and it is obvious that various changes and modifications will occur to those skilled in the art within the scope of the appended claims. Such variations are therefore understood to be within the technical scope of the present invention.

For example, in the above mentioned embodiment, although an image forming apparatus for performing monochrome image forming is applied to developing bias control according to the present invention, it is also possible to similarly apply to an image forming apparatus for performing color image forming.

What is claimed is:

1. An image forming apparatus for transferring a toner image formed on a latent image carrier to a recording medium to output an image, comprising:

a charging portion for charging a surface of the latent image carrier;

a developing device for developing an electrostatic latent image formed on the surface of the latent image carrier as a toner image;

a developing bias applying portion for applying a developing bias voltage to the developing device;

a surface potential sensor for measuring a surface potential of the latent image carrier;

an image density sensor for detecting an image density of the toner image formed on the surface of the latent image carrier; and a control portion for controlling an output value of the developing bias applying portion, wherein the control portion adjusts the developing bias voltage based on an average print coverage of document in previous printing jobs and an effective developing bias voltage which is based on the measured surface potential of the latent image carrier.

2. The image forming apparatus according to claim 1 comprising a toner concentration sensor for detecting a toner concentration of developer in the developing device.

3. The image forming apparatus according to claim 1, wherein the control portion adjusts the developing bias voltage to be applied to the developing device based on a value calculated by a primary linear approximation obtained from correlation between the effective developing bias voltage and a toner adherent amount on the latent image carrier with respect to the effective developing bias voltage.

4. The image forming apparatus according to claim 1 comprising a table showing a relationship between the average print coverage of document and the toner adherent amount on the latent image carrier, wherein the control portion corrects adjustment of the developing bias voltage based on the table.

5. The image forming apparatus according to claim 1 comprising a surface potential sensor for detecting a surface potential of the latent image carrier, wherein the control portion determines whether or not a measured value of the surface potential sensor is within a predetermined range, and when the measured value is not within the predetermined range, adjusting the surface potential of the latent image carrier so as to fall within the predetermined range.

6. The image forming apparatus according to claim 5 comprising a reporting portion for issuing an alarm, wherein the control portion operates the reporting portion when the measured value of the surface potential sensor exceeds the predetermined range.

7. The image forming apparatus according to claim 1 comprising an environmental state detecting portion for detecting a state of a surrounding environment, wherein the control portion corrects the developing bias voltage depending on change in a measured value of the environmental state detecting portion.

8. The image forming apparatus according to claim 1 comprising a lifetime counting portion for counting lifetime degree of the developer, wherein the control portion corrects the developing bias voltage depending on lifetime degree based on a measurement result of the lifetime counting portion.

9. An image forming method for transferring a toner image formed on a latent image carrier to a recording medium to output an image, comprising:

a step of charging a surface of the latent image carrier;

a step of developing an electrostatic latent image formed on the surface of the latent image carrier as a toner image;

a step of applying a developing bias voltage to the developing device;

a step of detecting a toner concentration of developer in the developing device;

a step of detecting an image density of the toner image formed on the surface of the latent image carrier;

a step of controlling an output value of the developing bias applying portion;

a step of measuring an average print coverage of document in previous print jobs;

a step of detecting a surface potential of the latent image carrier;

a step of adjusting the developing bias voltage based on the average print coverage of document and an effective developing bias voltage which is based on the measured surface potential of the latent image carrier;

a step of, when a value of the surface potential of the latent image carrier is not within a predetermined range, adjusting the surface potential so as to fall within the predetermined range; and a step of forming a plurality of reference toner images on the surface of the latent image carrier.

* * * * *